US008607764B2

(12) United States Patent
Judge et al.

(10) Patent No.: US 8,607,764 B2
(45) Date of Patent: Dec. 17, 2013

(54) FLUID ACCUMULATOR ARRANGEMENT FOR AN INTERNAL COMBUSTION ENGINE

(75) Inventors: Richard A. Judge, Gillingham (GB); Kenneth L. Smith, Rainham (GB)

(73) Assignee: Delphi Technologies Holding S.arl, Luxembourg (LU)

( * ) Notice: Subject to any disclaimer, the term of this patent is extended or adjusted under 35 U.S.C. 154(b) by 278 days.

(21) Appl. No.: 13/124,190

(22) PCT Filed: Oct. 21, 2009

(86) PCT No.: PCT/EP2009/063809

§ 371 (c)(1),
(2), (4) Date: Apr. 14, 2011

(87) PCT Pub. No.: WO2010/046398

PCT Pub. Date: Apr. 29, 2010

(65) Prior Publication Data

US 2011/0209779 A1 Sep. 1, 2011

(30) Foreign Application Priority Data

Oct. 22, 2008 (EP) ..... 081672438

(51) Int. Cl.
*F02M 55/02* (2006.01)
*F02M 55/00* (2006.01)

(52) U.S. Cl.
USPC ..... 123/456; 123/458; 123/463

(58) Field of Classification Search
USPC ..... 123/456, 447, 457, 458, 463, 491, 492, 123/493, 497, 511, 512; 701/110, 113
See application file for complete search history.

(56) References Cited

U.S. PATENT DOCUMENTS

| | | | | |
|---|---|---|---|---|
| 5,456,233 | A * | 10/1995 | Felhofer | 123/447 |
| 5,642,714 | A | 7/1997 | Buckley | |
| 5,651,346 | A * | 7/1997 | Remmels et al. | 123/447 |
| 5,727,525 | A * | 3/1998 | Tsuzuki | 123/447 |
| 5,787,863 | A * | 8/1998 | Henig et al. | 123/447 |
| 6,234,128 | B1 | 5/2001 | Reuss | |
| 6,405,710 | B1 | 6/2002 | Brehob | |

(Continued)

FOREIGN PATENT DOCUMENTS

| | | |
|---|---|---|
| CN | 101210529 | 7/2008 |
| DE | 10 2005 053470 | 6/2006 |

(Continued)

OTHER PUBLICATIONS

Letter regarding Japan Office Action dated Oct. 22, 2012.

(Continued)

*Primary Examiner* — Mahmoud Gimie
(74) *Attorney, Agent, or Firm* — Mark H. Svoboda

(57) ABSTRACT

A fluid accumulator arrangement suitable for use with a compression ignition internal-combustion engine comprising a first storage volume, a second storage volume, and valve means fluidly connected between the first storage volume and the second storage volume. In one embodiment, the valve means is a three-way control valve wherein, in a first position, the first storage volume communicates with the second storage volume, in a second position the first storage volume is isolated from the second storage volume and, in a third position, one of the first or second storage volumes communicates with a low pressure drain. The arrangement may also include control means to operate the valve means in accordance with predetermined control strategies.

15 Claims, 7 Drawing Sheets

(56) References Cited

U.S. PATENT DOCUMENTS

| | | | | |
|---|---|---|---|---|
| 6,415,770 | B1 * | 7/2002 | Kojima | 123/511 |
| 7,431,017 | B2 * | 10/2008 | Gibson | 123/446 |
| 2001/0054412 | A1 | 12/2001 | Kojima | |
| 2004/0055574 | A1 | 3/2004 | Namekawa et al. | |
| 2007/0277783 | A1 | 12/2007 | Gibson | |

FOREIGN PATENT DOCUMENTS

| | | |
|---|---|---|
| EP | 0711914 | 5/1996 |
| EP | 1167744 | 1/2002 |
| EP | 1378659 | 1/2004 |
| FR | 2889259 | 2/2007 |
| JP | 63-90658 | 4/1988 |
| JP | 11-62682 | 3/1999 |
| JP | 11-218066 | 8/1999 |

OTHER PUBLICATIONS

China Office Action dated Dec. 4, 2012.

* cited by examiner

FLUID ACCUMULATOR ARRANGEMENT FOR AN INTERNAL COMBUSTION ENGINE

TECHNICAL FIELD

The invention relates to an accumulator arrangement for high pressure fluid. More specifically, although not exclusively, the invention relates to an accumulator arrangement for storing high pressure fuel in a fuel injection system of a compression-ignition internal combustion engine.

BACKGROUND OF THE INVENTION

The compression-ignition internal combustion engine, or 'diesel' engine as it is more commonly known in the art, is a propulsion system that is used in many on-road and off-road applications, for example: small and large family cars, freight carrying vehicles, electrical power generation and marine propulsion systems.

As shown in FIG. 1, a typical diesel engine system 2 includes an engine block 4 and a fuel delivery system 6 for delivering fuel to the cylinders (not shown) of the engine block 4. The fuel delivery system 6 comprises a plurality of electronically-operated fuel injectors 8, one associated with each respective cylinder of the engine block 4. It should be appreciated that the diesel engine system 2 shown in FIG. 1 has been simplified for present purposes.

The fuel injectors 8 are supplied with high pressure fuel from a high pressure fuel accumulator volume 10, which is more usually referred to as a 'common rail'. The common rail 10 is in the form of a metallic body that defines an internal volume for receiving and housing pressurised fuel. A fuel pump 12 draws low pressure fuel from a fuel tank 14, and supplies high pressure fuel to the common rail 10.

The volume of fuel that is delivered by the injectors 8 to the engine is controlled by an engine control system 16. The engine control system 16 receives, by way of a sensor input data link 18, real time data relating to many vehicle parameters such as engine speed, engine temperature and throttle pedal position and, in response to such sensor input, calculates an appropriate volume of fuel to deliver to the cylinders of the engine so as to achieve the desired operating condition.

The volume of fuel that is delivered by the injectors 8 is generally a function of the pressure of fuel and the time period for which the injector is 'open'. It is therefore important for the pressure of fuel stored in the common rail 10 to be controlled precisely in order for the combustion process to be maintained at an optimum level.

There are certain considerations that govern the design of a common rail for any given application. For instance, in some engine applications the load on the engine changes abruptly. In order to maintain optimum combustion under such load changes it is desirable for the pressure of fuel within the common rail to be increased significantly and promptly when the engine load increases. In such circumstances it is preferable for the internal volume of the common rail to be kept relatively small. On the other hand, it is desirable for the pressure of fuel in the common rail to be unresponsive to injector filling events and a larger volume is more suitable for this purpose. However, in practice, each of these design constraints comes with disadvantages so the design of the common rail results in a compromise between providing a common rail with sufficient volume so that it is acceptably robust to unwanted pressure changes but with a small enough volume so that the high pressure fuel pump can change the fuel pressure in the common rail rapidly enough to maintain optimum combustion.

It is an object of the invention to provide an improved common rail that avoids or at least mitigates at least some of the aforementioned problems that are associated with existing high pressure common rail devices.

SUMMARY OF THE INVENTION

According to a first aspect of the invention, there is provided a fluid accumulator arrangement suitable for use with a compression ignition internal-combustion engine comprising a first storage volume, a second storage volume, and a valve fluidly connecting the first storage volume and the second storage volume, wherein the valve is a three-way control valve and wherein, in a first position, the first storage volume communicates with the second storage volume, in a second position the first storage volume is isolated from the second storage volume and, in a third position, one of the first or second storage volumes communicates with a low pressure drain.

The invention has particular utility in the context of a diesel engine in which the accumulator volume (hereinafter 'common rail') is fluidly connected to a plurality of fuel injectors that are arranged to deliver high pressure fuel to respective cylinders of the engine. Therefore, the invention described hereinafter extends to a fuel injection system comprising such a common rail, a fuel pump arranged to supply pressurised fuel to the common rail and a plurality of injectors arranged to be supplied with fuel by the common rail.

The advantage of the invention is that the common rail is divided into two separable storage volumes that are linked by an electrically operated valve, the effect of which is to provide a variable volume common rail. As a result, the total volume of the common rail for storing pressurised fuel can be maximised by linking the first and second storage volumes which ensures that the fluid pressure in the rail is relatively unaffected by fuel injection events. Alternatively, the first and second storage volumes may be isolated such that the pressure of fuel in the common rail can be increased or decreased rapidly in response to a change in engine load that demands a change in rail pressure.

A further advantage is that pressurised fuel in the second storage volume may be discharged to low pressure without affecting the pressure in the first storage volume, such a situation being desirable for some combustion requirements and/or to reduce system stresses.

In a further embodiment of the invention there may be provided a further one or more storage volumes with respective valve to connect said further one or more storage volumes to the first storage volume. This embodiment provides the advantage that the total volume of the accumulator arrangement may be varied in a step-wise manner for greater volumetric control.

In one embodiment of the invention, the first storage volume is a primary volume and, as such, is provided with connections to each of the plurality of injectors in the fuel injection system and is also provided with a connection to the high pressure fuel pump.

In addition, the first storage volume may also be provided with a pressure sensor preferably in the form of an invasive pressure sensor installed therein. Due to its installation in the first storage volume, the pressure sensor senses the pressure of fuel in the first storage volume alone when it is isolated from the second storage volume, and senses the pressure of fuel in the combined first and second storage volumes when they are connected by the valve. Alternatively, or in addition, the second volume may also be provided with a suitable pressure sensor.

In a second aspect, there is provided a fluid accumulator arrangement suitable for use with a compression ignition internal-combustion engine comprising a first storage volume, a second storage volume, and a valve fluidly connecting the first storage volume and the second storage volume, wherein the valve is operable between first and second positions such that, in the first position, the first storage volume communicates with the second storage volume and, in the second position, the first storage volume is isolated from the second storage volume. The arrangement further comprises a further one or more storage volumes each provided with a respective one of one or more further valves to connect said further one or more storage volumes to the first storage volume.

It should be noted at this point that preferred and/or optional features of the first aspect of the invention may be combined as appropriate with the second aspect of the invention, and vice versa.

In order for the fluid flow between the first storage volume and the second storage volume to be controlled by an electronic control arrangement, the valve may be an electrically actuated valve. In its simplest form, the valve may be a two-way valve in which, in a first position, the first storage volume communicates with the second storage volume and, in a second position, communication between the first storage volume and the second storage volume is prevented.

From another aspect, there is provided a fluid accumulator arrangement for use in a fuel injection system, the accumulator arrangement including a first storage volume, a second storage volume, and a valve fluidly connecting the first storage volume and the second storage volume, and a control module arranged to receive a signal indicative of the stability of an engine operating condition and being operable to control the valve in response to the signal.

In order for the pressure in the first and second storage volumes to be substantially unaffected by the operation of injectors associated therewith, it is preferred that the control module operates the valve such that the first storage volume communicates with the second storage volume in circumstances in which the signal (for example, fuel pressure demand in the first, primary volume) indicates a relatively stable engine running condition.

Alternative, or in addition, the valve control module operates the valve such that the first storage volume is isolated from the second storage volume in circumstances in which the signal indicates a relatively unstable engine running condition. Therefore, a pumping system that is used to supply pressurized fuel to the first storage volume is able to raise the pressure of fuel contained in the first storage volume to keep pace with the demanded fuel pressure. Advantageously, this enables a lower capacity pump to be used in such a system.

It should be noted that although it is envisaged that a fuel pressure demand signal would be suitable to use as representing the stability of the engine operating condition, other parameters could also be suitable: for example, a value indicating the error between the demanded fuel pressure and the actual fuel pressure; rate of change of throttle position.

In one embodiment, the valve control module is arranged to receive a signal indicative of an engine start event, in which circumstances the valve control module operates the valve such that the first storage volume is isolated from the second storage volume. As a result of this, the pressure of fuel within the first storage volume can be raised more quickly than when the first and second storage volumes are linked, which is beneficial during engine starting.

In a further aspect, there is provided a fluid accumulator arrangement including a first storage volume, a second storage volume, a valve fluidly connecting the first storage volume and the second storage volume, and a control module arranged to receive a signal indicative of an engine start event, in which circumstances the control module is operable to i) determine a first pressure value indicative of fluid pressure in the first storage volume; ii) determine a second pressure value indicative of fluid pressure in the second storage volume; iii) calculate a third pressure value indicative of fluid pressure in the combined volume of the first storage volume and second storage volume; iv) compare the third pressure value with a predetermined threshold value; and iv) operate the valve to fluidly link the first storage volume and the second storage volume if the third pressure value is substantially equal to or greater than the predetermined threshold.

In order that a suitable engine associated with the accumulator arrangement may be started as rapidly as possible from key-on, the aforementioned predetermined threshold value may represent the minimum fluid pressure required in the first storage volume required to initiate a combustion event in the engine.

Further, the control module may be arranged to receive a signal of an engine stop event and, in response, to configure the valve to isolate the first storage volume from the second storage volume prior to a subsequent engine start event.

The control module may be configured to operate the valve during operation of an associated engine to optimise the pressure in the second storage volume.

Suitably, this may involve the control module being configured to monitor the pressure of fuel in the first storage volume and the second storage volume when the volumes are isolated from one another, and being configured to link the first storage volume to the second storage volume for a predetermined time period in circumstances where the pressure in the first storage volume exceeds the pressure in the second storage volume.

It should be appreciated that preferred and or optional features of the various aspects of the invention described above may be combined with one another as appropriate.

SPECIFIC DESCRIPTION OF THE EMBODIMENTS

Figure 1:
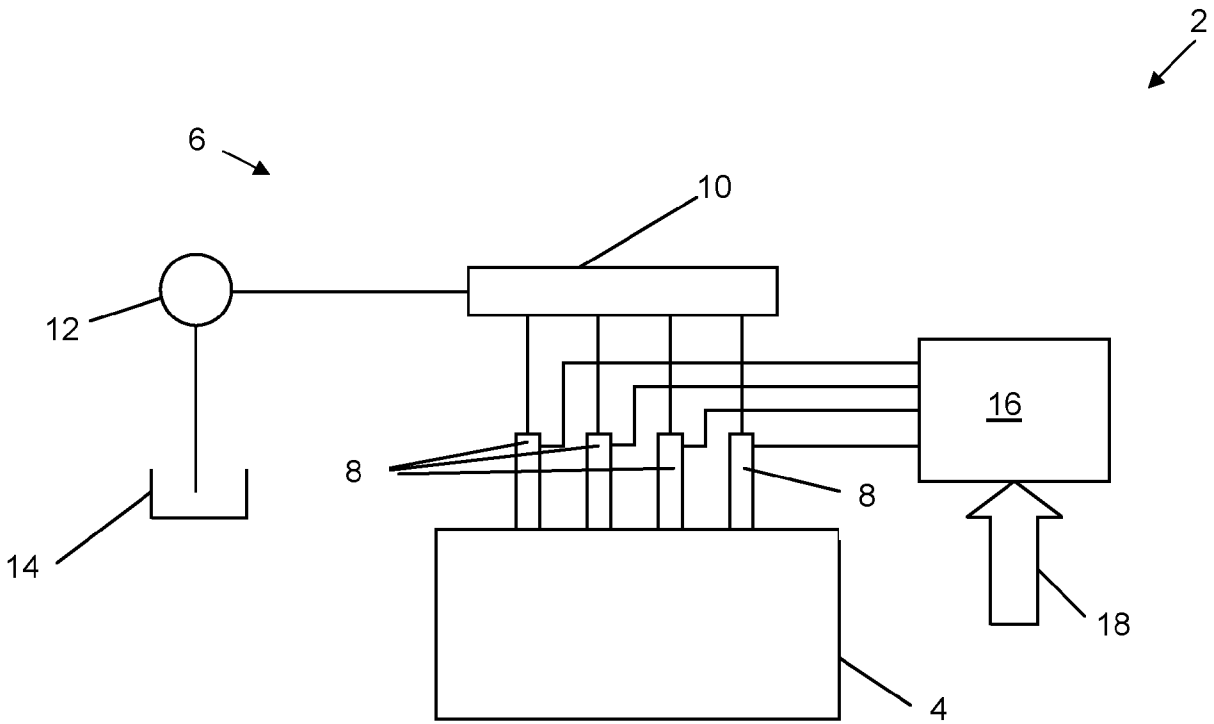
FIG. 1 is a simplified schematic view of a known diesel engine system.
Figure 2:
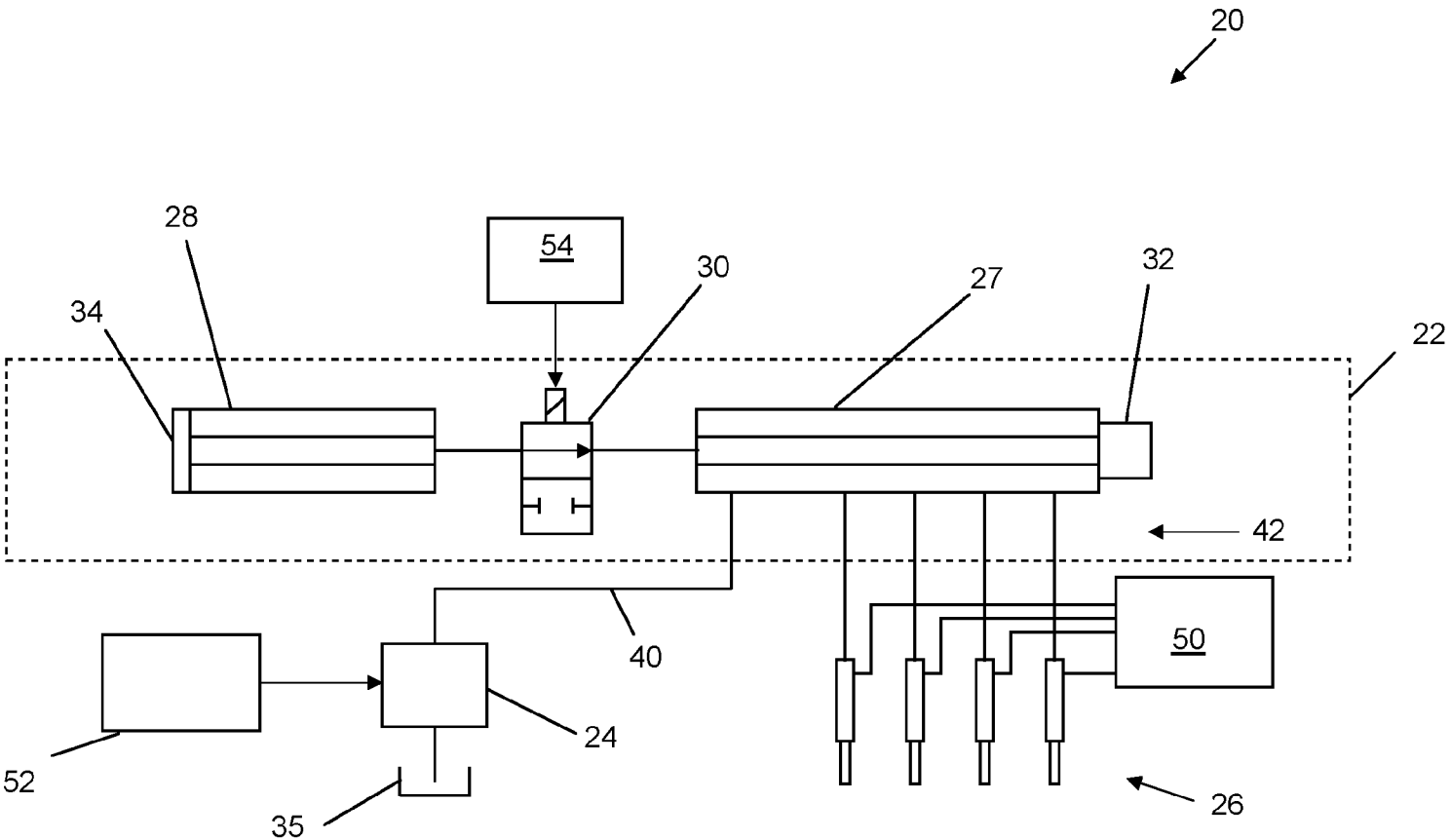
FIG. 2 is a schematic view of a common rail arrangement of a first embodiment of the invention.

Referring to FIG. 2, a fuel injection system 20 is shown schematically and includes an accumulator, or 'common rail', arrangement 22 (shown bounded by the dashed line) that is connected to a high pressure fuel pump 24 and a plurality of fuel injectors 26. Although not shown in FIG. 2, in use, the fuel injectors 26 are installed in an engine block of an internal combustion engine to deliver fuel to respective cylinders of the engine.

The common rail arrangement 22 comprises three main components: a first storage volume 27, a second storage volume 28 and a valve means in the form of an electrically actuated two-way valve 30 that fluidly connects the first storage volume 27 to the second storage volume 28. Hereafter, the first storage volume 27 will be referred to as the 'primary volume' and the second storage volume 28 will be referred to as the 'secondary volume', the primary volume 27 being shown having a larger capacity than the secondary volume 28.

The primary volume 27 and the secondary volume 28 are relatively thick metal-walled tubes that are configured to contain and withstand high pressure fluid in the form of diesel fuel. For the purposes of this invention, the exact configuration of the primary and secondary volumes 27, 28 is not critical and the skilled person will appreciate that they may take other forms, for example spherical or part-spherical pressure vessels which are capable of storing fluid from pressures of around 150 bar up to pressures in the region of 2000 to 3000 bar.

An inner end of each of the primary and secondary volumes 27, 28 is connected to the two-way valve 30 thereby fluidly connecting one volume to the other. The two-way valve 30 is operable between first and second positions. In the first position, as is shown in FIG. 2, the primary volume 27 is in fluid communication with the secondary volume 28 such that a single, relatively large volume for high pressure fuel is provided. However, in the second position, the two-way valve 30 breaks communication between the primary volume 27 and the secondary volume 28. Thus, the two-way valve 30 provides a means to vary the total accumulator volume by selectively opening and closing communication between the first and second storage volumes 27, 28.

A pressure sensing means in the form of an invasive pressure sensor 32 is installed on an outer end of the primary volume 27 opposite the two-way valve 30. Although it is not essential for the pressure sensor 32 to be mounted on the primary volume 27 (pressure sensing means could be provided elsewhere in the system; at the injector inlets for example), the pressure sensor 32 provides a reliable and cost-effective means to measure the pressure of fuel within the primary volume 27. An outer end of the secondary volume 28 is sealed by a sealing member 34, although it should be appreciated that a separate sealing member is not essential and the closed end could be an integral part of the secondary volume 28. Alternatively, the outer end of the secondary volume 28 may also be provided with a pressure sensor in order to provide a direct means to evaluate the fuel pressure therein.

The high pressure pump 24 draws low pressure fuel from a fuel tank 35 and supplies pressurised fuel to the primary volume 27 by way of a first high pressure connection 40. Each of the four fuel injectors 26 is also connected to the primary volume 27 by additional respective high pressure connections 42. It should be noted that although not shown here for ease of understanding, the fuel injection system may also include one or more fuel filters, lift pumps and/or fuel coolers/heaters.

The fuel injection system 20 also includes an injection control module or 'unit' 50 which is electrically connected to the fuel injectors 26 in order to control the injection of fuel therefrom, a pump control module or 'unit' 52 electrically connected to the fuel pump 24 in order to control its fluid output rate to the primary volume 27, and a valve control module or 'unit' 54 to control the operation of the two-way valve 30 according to an appropriate control strategy, to be described in further detail later.

It should be appreciated that although the valve control module 54, the pump control module 52 and the injector control module 50 have been described as individual units, in practice, the functionality of these units may be combined so as to come under the authority of an engine management system (not shown) which coordinates the functionality of the units, and other vehicle sub-systems, in order to provide the desired operation of the fuel injection system 20.

Figure 3:
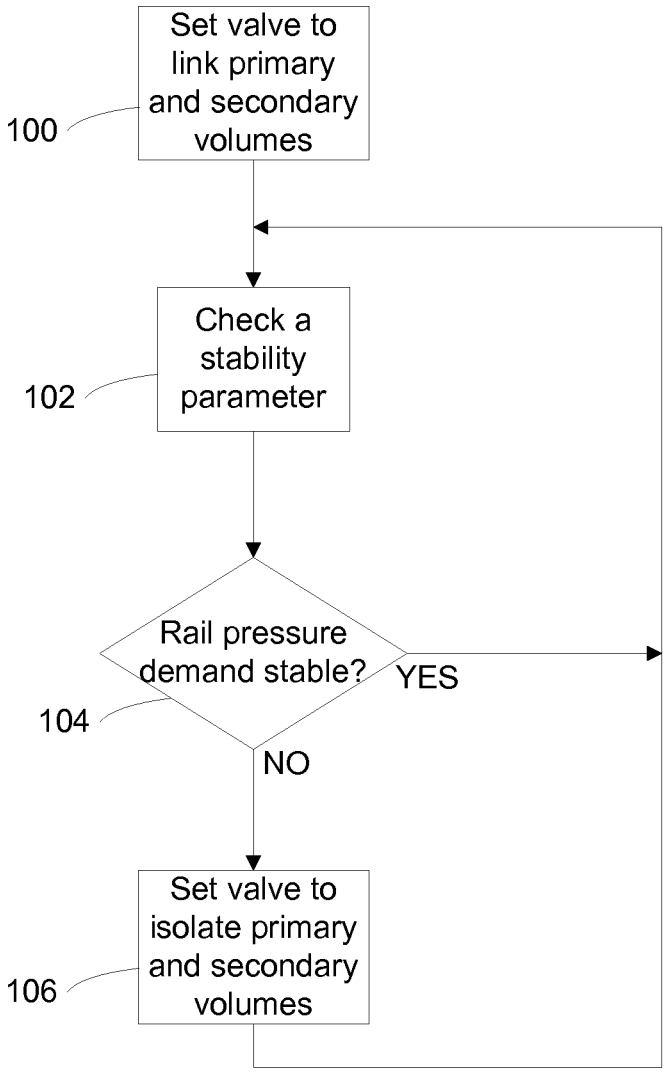
FIG. 3 is a flow diagram of a control strategy applicable to the common rail arrangement of FIG. 2.

FIG. 3 illustrates one example of a control strategy implemented by the valve control module in FIG. 2, the control strategy being particularly suited to optimising the transient response of the fuel pressure in the common rail arrangement 22 to changes in demanded rail pressure.

Consider, for example, a road vehicle cruising along a carriageway, the road vehicle having an engine in which the fuel injection system 20 of the invention is installed. In such a stable engine operating condition, the fuel delivery rate demanded by the engine, and therefore the demanded fuel pressure, is relatively constant and substantially stable. In such circumstances, it is preferable for the overall volume of the common rail arrangement to be large so that the pressure is relatively unaffected by pumping pulses and the intermittent operation of the fuel injectors. Therefore, the valve control module 54 sets the two-way valve 30 into the first position so as to link the primary and secondary volumes 27, 28. This initial condition of a suitable control strategy is represented in FIG. 3 by step 100. In other words, the pressure of fuel in the rail is robust to small perturbations caused by injection events and filling pulses.

The control strategy in FIG. 3 carries out continual monitoring of the rail pressure demand signal that it used by the pump control module 52 to determine the volume of fuel that needs to be supplied to the common rail in order to meet the demanded fuel rail pressure. This can be seen at checking step 102 at which point the control strategy checks a stability parameter which, for present purposes, is the rail pressure demand signal.

At decision step 104, the control strategy determines whether the rate of change of the fuel rail pressure demand signal is stable; that is to say within predefined acceptable levels. If the rail pressure demand signal is determined to be stable, the valve control module 54 maintains the two-way valve 30 in the first position so that the volumes of the primary and second volumes are combined. Such circumstances may be where there is only a relatively gradual change in engine operating condition causing only moderate instability in the rail pressure demand signal, for example during moderate acceleration or when the road vehicle is travelling up a moderate incline. The process then loops back to step 102 and will continue monitoring in this manner until the stability parameter becomes unstable.

During relatively rapid changes in engine operating conditions, for example under heavy acceleration, or unstable acceleration, during which the rail pressure demand signal will change comparatively quickly, the decision step 104 returns a negative value and the valve control module 54 operates the two-way valve 30 so that it occupies its second position thereby isolating the secondary volume 28 from the primary volume 27, as represented by step 106. In this situation, since the fuel pump 24 is only supplying fuel to the primary volume 27, the pump control module 52 is better able to control the fuel pump 24 so as to change the pressure of fuel in the primary volume 27 quickly to keep up with the change in fuel pressure demanded by the injector control module 50.

Following step 106, the strategy loops back to step 102 and thus continues to monitor the rail pressure demand signal such that the primary and secondary volumes 27, 28 will remain isolated by the valve 30 until the rail pressure demand signal returns to a stable condition.

In the above-described operating strategy, the valve control module 54 is operable to optimise the transient response performance of the common rail arrangement 22, whilst ensuring that the pressure in the common rail arrangement is robust to relatively gradual changes in input and output. It should be noted at this point that although the control strategy bases the decision on the status of the valve 30 on the stability of the rail pressure demand signal, it is equally possible for other signals to be used. As a non-limiting example, two such parameters from which a measure of engine stability can be derived are the error signal representing the mismatch between the demanded rail pressure and actual rail pressure, and the delivery demand signal indicating the required fuel delivery from the injectors.

Figure 4:
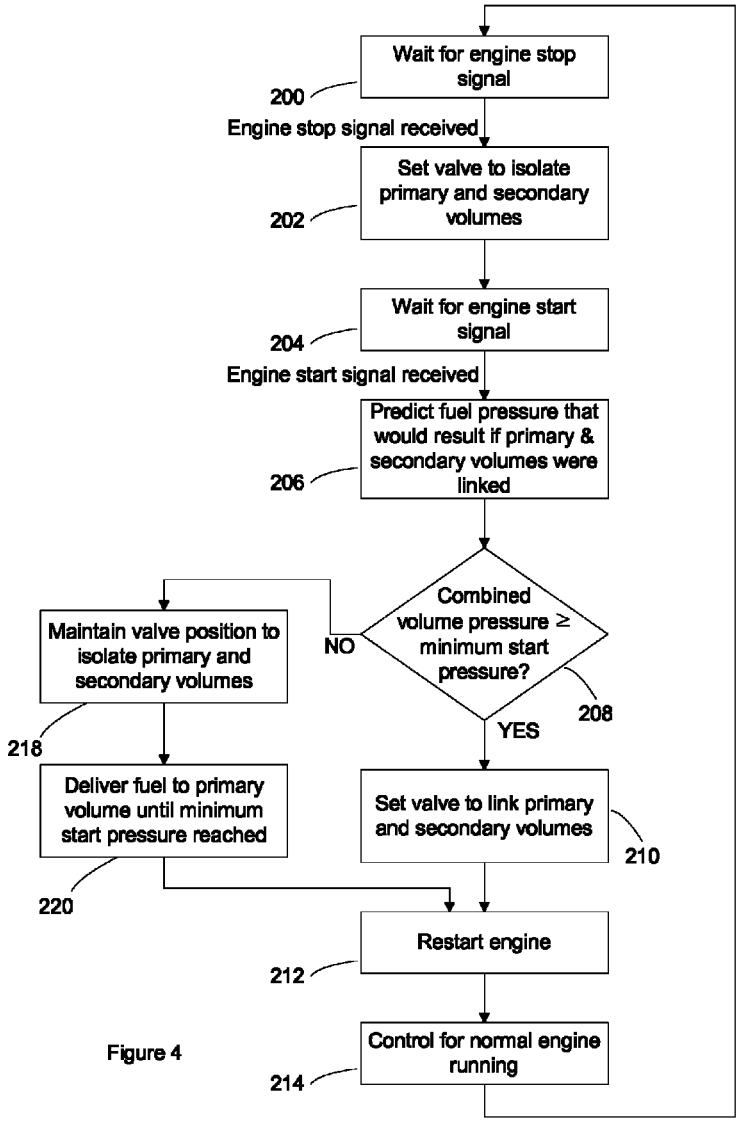
FIG. 4 is a flow diagram of an alternative control strategy.

Another circumstance in which the valve control module 54 maintains the two-way valve 59 in the second position is during an engine start event and particularly during the time period following engine start when it may be necessary to bring the fuel rail pressure up to a relatively high level quickly. Isolating the primary and secondary volumes 27, 28 during an engine start event, as is described in further detail below, is beneficial because the pump control system 52 is able to operate the fuel pump 24 to achieve the desired fuel pressure in a reduced time compared to a fuel injection system which is equipped with only a single-volume common rail arrangement. In this respect, FIG. 4 illustrates a further control strategy that may be implemented by the valve control module 54 to improve the starting speed of the engine.

At step 200, the engine is running normally and the valve control module 54 is operating the valve 30 of the common rail arrangement 22 in accordance with a predetermined valve control strategy, for example as described above with reference to FIG. 3 or, alternatively, as described below with reference to FIG. 5. At this point, the valve control strategy is in a wait state and monitors for an engine stop signal to be received from the engine management system.

At step 202, the valve control module 54 receives an engine stop signal and, in response, ensures that the valve 30 is actuated so as to isolate the primary volume 27 from the secondary volume 28 such that pressurised fuel is trapped in the secondary volume 28. At this point, the valve control strategy enters a further wait state and monitors for an engine start signal to be received from the engine management system. It should be noted that following an engine stop signal, the pressure in the primary volume 27 is caused to reduce substantially to ambient pressure so as reduce stresses in the system.

Upon receipt of an engine start signal, at step 204, the valve control strategy begins a process to determine the most appropriate action for the valve 30 in order to minimise the start time for the engine. As a first action in this process, at step 204, the valve control strategy evaluates the pressure of fuel contained in the secondary volume 28 by reading a pressure sensor attached thereto (not show in FIG. 2). Alternatively, it should be appreciated that the pressure in the secondary volume could be determined by retrieving, from memory, a value representing the pressure in the primary volume just prior to the primary and secondary volumes being isolated-note at this point the pressure in the primary and secondary volumes are equal.

At step 206, a calculation is performed to determine the pressure of fuel that would result if the primary and secondary volumes 27, 28 were linked by appropriate operation of the valve 30.

At step 208, the value calculated in step 206 (hereinafter referred to as the 'combined volume pressure') is compared with a predetermined value representing the minimum fuel pressure that is necessary to enable the engine to start i.e. for combustion to be carried out in the cylinders of the engine, which is hereinafter referred to as the 'minimum start pressure'.

If step 208 determines that the combined volume pressure is equal to or greater than the minimum start pressure, then the strategy continues to step 210 at which the valve control module operates the valve 30 so as to link the primary and secondary volumes 27, 28. Following this action, the high pressure pump 24 is configured by the pump control module 52 to deliver fuel to the common rail arrangement 22 at a minimum delivery rate, since no fuel delivery is necessary in order for the common rail to reach minimum start pressure.

Finally, at step 212, the engine is restarted and the process continues to step 214 at which point the current valve control strategy passes control to an alternative control strategy for normal engine running and then proceeds to step 200 to await the next occurrence of an engine stop signal. At this point, for example, the valve 30 may be commanded to isolate the primary and secondary volumes in order to raise the pressure in the primary volume as rapidly as possible.

Returning to decision step 208, if it is determined that the combined volume pressure is less than the minimum restart pressure, then the process moves to step 218 in which the valve 30 is maintained in position to isolate the primary and secondary volumes 27, 28 and, subsequently, to step 220 in which the pump control module 52 configures the fuel pump 24 to provide a maximum fuel delivery rate to the primary volume 27 until the minimum restart pressure is reached. Following this, the process proceeds to step 212, at which point the engine is restarted and subsequently to step 214 at which point the current valve control strategy passes control to an alternative control strategy for normal engine running and step 200 to await the next occurrence of an engine stop signal.

The advantage of this control strategy embodiment is that the minimum restart pressure for the engine is reached nearly instantaneously, should the combined volume pressure be calculated to be sufficient, merely by operating the valve 30 so that the stored pressure in the secondary volume 28 is allowed to boost the pressure in the combined primary and secondary volumes 27, 28.

To complement the control strategy described above with reference to FIG. 4 it is desirable, although not essential, that the pressure in the secondary volume 28 is as high as possible when the engine stop signal is received by the valve control module 54 at step 202. Therefore, an alternative control strategy to that described with reference to FIG. 4 may be implemented by the valve control module 54 whilst the engine is running to ensure that the secondary volume is at a suitable pressure in preparation for a subsequent engine stop event.

Figure 5:
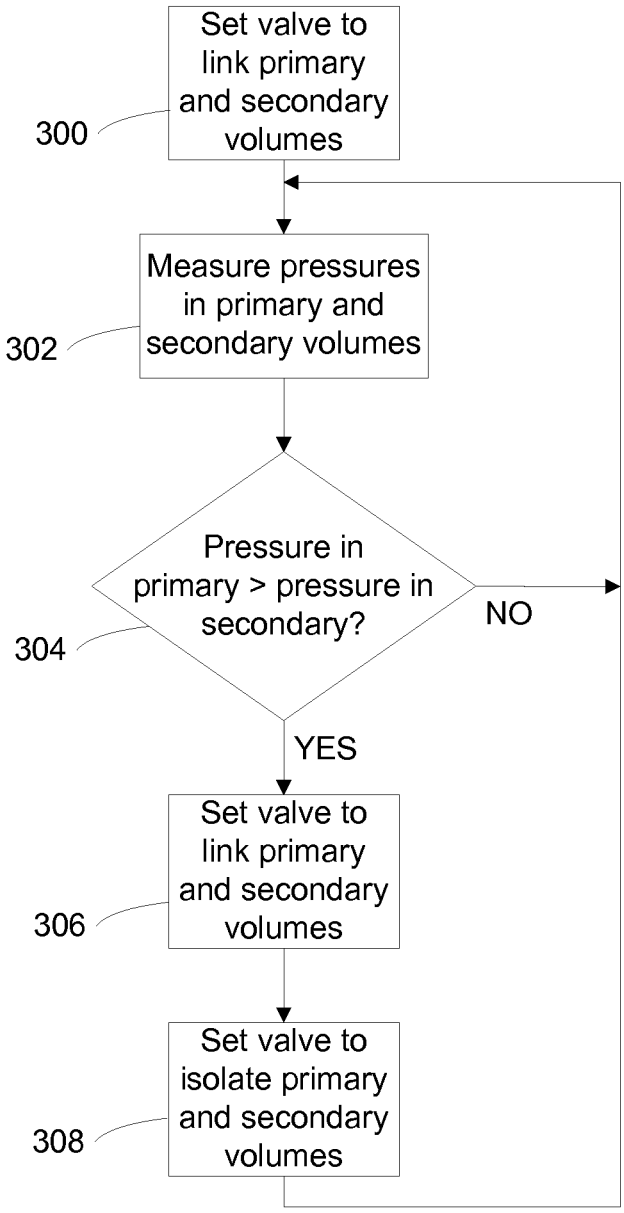
FIG. 5 is a flow diagram of a further alternative control strategy.

With reference to FIG. 5, an alternative valve control strategy begins at step 300 at which point the engine is running substantially stably and that the valve 30 is at its second position in which the primary volume 27 is isolated from the secondary volume 28.

At step 302, the process enters a monitoring phase at which the pressures in both the primary volume 27 and the secondary volume 28 are measured, and then the two values are compared at decision step 304. If it is determined that the pressure in the primary rail volume is less than the pressure in the secondary rail volume, the process loops back to step 302 and repeats.

However, if it is determined that the pressure in the primary volume 27 is greater than the pressure in the secondary volume 28, the process moves to step 306 at which the valve control module 54 operates the valve 30 so as to link the primary volume 27 to the secondary volume 28 for a predetermined time period, sufficient to allow the pressures in the two volumes being equalised.

At step 308, the valve control module 54 operates the valve 30 once again so that it returns to its first position so as to isolate the primary volume 27 from the secondary volume 28, thereby by trapping a maximised fuel pressure therein in the secondary volume 28. The process then loops back to step 302 whereupon the monitoring phase is continued. Beneficially, this embodiment ensures that the secondary volume 28 always is at the highest pressure possible which is particularly suitable to the control strategy for an engine start event described above with reference to FIG. 4 which improves the likelihood that the pressure of the combined primary and secondary volume will either meet or exceed the minimum start pressure.

It should be appreciated that in this embodiment, since the primary and secondary volumes are generally isolated from one another during normal engine operating conditions, it is preferable for the primary volume 28 to be significantly larger than the secondary storage volume 28

Figure 6:
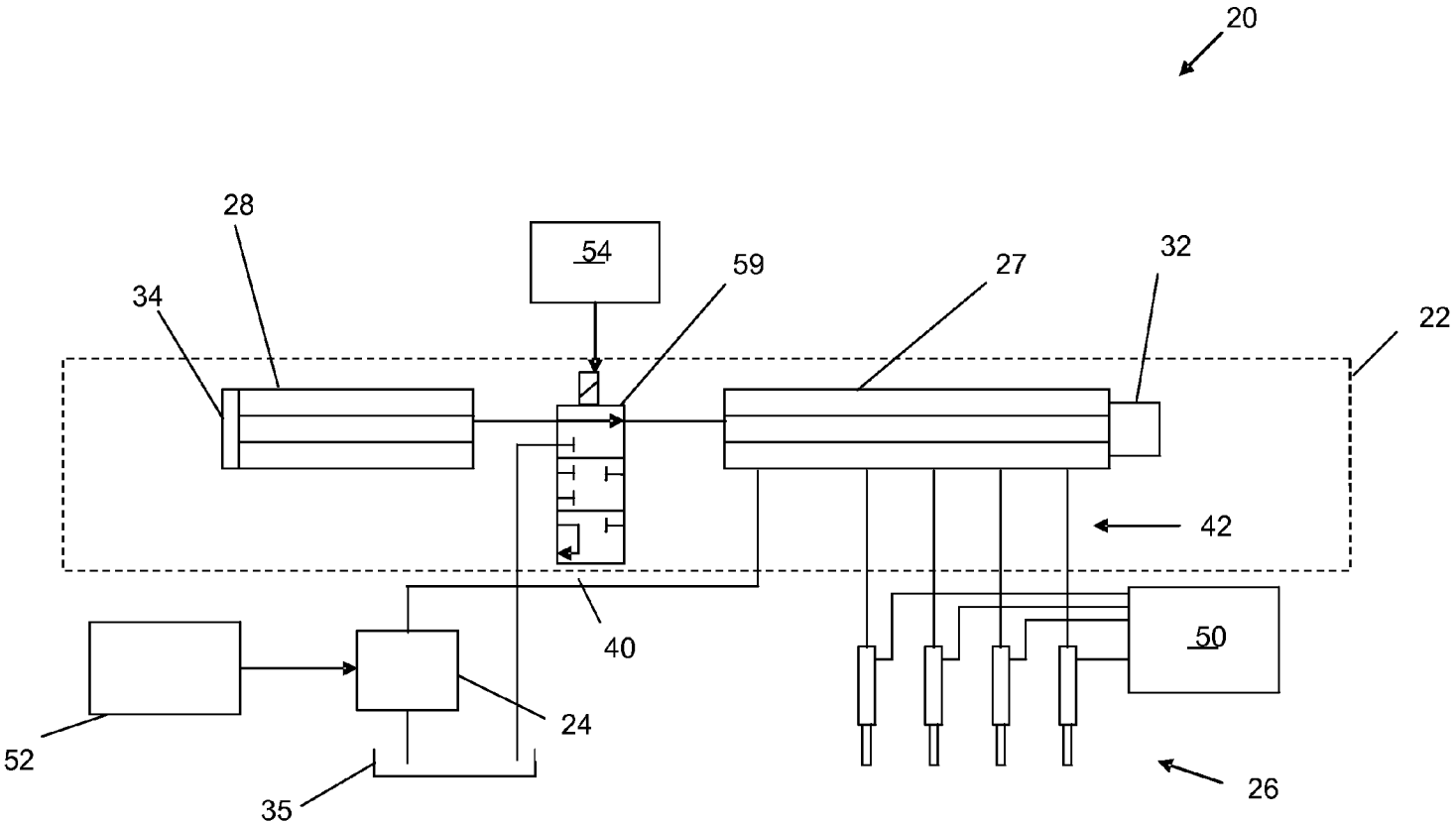
FIG. 6 is a schematic view of an alternative common rail arrangement to that in FIG. 2.

Having described an alternative control strategies above, an alternative configuration of the common rail arrangement 22 is shown in FIG. 6, in which like parts to those in FIG. 2 are denoted by like reference numerals. The common rail arrangement 22 in FIG. 6 is substantially the same as in FIG. 2 so only the differences will be described here. Also, it should be noted that the control strategies of FIGS. 3, 4 and 5 are applicable to the common rail arrangement of FIG. 6.

In FIG. 6, the common rail arrangement 22 includes an electrically operable three-way valve 59. The three-way valve 59 is operable in first and second positions in the same way as the two-way valve 30 in the embodiment in FIG. 2 but it is also operable in a third position in which the primary volume 27 is isolated from the secondary volume 28 and the secondary volume 28 communicates with a low pressure drain, for example the fuel tank 35 of the vehicle. Beneficially, therefore, the pressurised fuel in the secondary volume may be discharged without affecting the pressure of fuel in the primary volume which may be desirable for certain engine combustion requirements and/or to reduce stresses in the system.

In an additional or alternative variation on the above embodiment, the three-way valve 59 may also be configured to be operable to a position so that the primary volume 27 is linked to the low-pressure drain 35.

It should be appreciated that various modifications may be made to the above embodiments without departing from the overall concept of the invention, as defined by the claims. For example, although it has been described above that the primary volume is larger than the secondary volume, this need not be the case and the secondary volume could be equal in size to, or indeed larger than, the primary volume depending on the design consideration of the application with which the system is to be used. In addition, it will be appreciated that the exact configuration of the fuel injection system shown in FIGS. 2 and 6 is exemplary only and is not intended to limit the invention. For example, although a pump is illustrated as pumping fuel directly from the tank, to the common rail arrangement, in practice the fuel injection system would also likely include fuel filters, and even fuel coolers or fuel heaters, although these are not essential to the inventive concept, as defined by the appended claims. Furthermore, although only a single secondary volume has been described above with reference to FIGS. 2 and 6, further embodiments will now be described that provide a greater degree of volumetric control.

Figure 7:
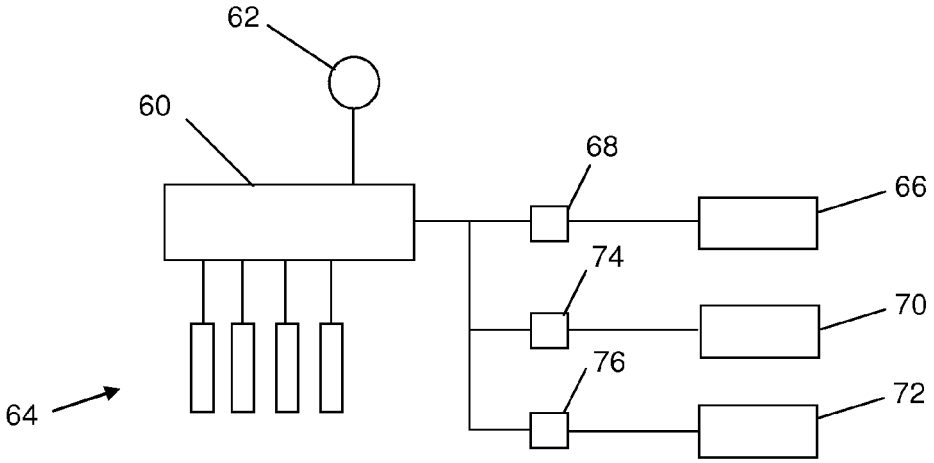
FIG. 7 is a schematic view of a further alternative common rail arrangement.

FIG. 7 shows a fuel injection system including a common rail arrangement in simplified schematic form for ease of understanding. As with the embodiments of FIGS. 2 and 6, there is provided a primary fuel volume 60 which receives pressurised fuel from a high pressure fuel pump 62 and which supplies pressurised fuel to a plurality of fuel injectors 64. However, in this embodiment, in addition to a secondary volume 66 connected to the primary volume 60 via a valve 68, there is also provided third and fourth volumes 70, 72 each of which is also connected to the primary volume 62 via respective valves 74, 76. By suitable electronic control over the operation of the valves 68, 74, 76 the total volume of the accumulator arrangement is variable with a greater degree of control which may provide further benefit in terms of combustion efficiency. Of course, each of the valves 68, 74 and 76 may be either a two-way or three-way valve as appropriate.

The invention claimed is:

1. A fluid accumulator arrangement suitable for use with a compression-ignition internal combustion engine, including a first storage volume, a second storage volume, a valve fluidly connecting the first storage volume and the second storage volume, and control module arranged to receive a signal indicative of an engine start event, in which circumstances the control module is operable to:

i) determine a first pressure value indicative of fluid pressure in the first storage volume;

ii) determine a second pressure value indicative of fluid pressure in the second storage volume;

iii) calculate a third pressure value indicative of fluid pressure in the combined volume of the first storage volume and second storage volume;

iv) compare the third pressure value with a predetermined threshold value;

iv) operate the valve means to fluidly link the first storage volume and the second storage volume if the third pressure value is substantially equal to or greater than the predetermined threshold.

2. The fluid accumulator arrangement of claim 1, wherein the predetermined threshold value is indicative of the minimum fluid pressure required in the first storage volume required to initiate a combustion event in an associated engine.

3. The fluid accumulator arrangement of claim 1, wherein the control module is arranged to receive a signal of an engine stop event and, in response, configures the valve to isolate the first storage volume from the second storage volume prior to a subsequent engine start event.

4. The fluid accumulator arrangement of claim 1, wherein the control module is configured to operate the valve during operation of an associated engine to optimize the pressure in the second storage volume.

5. The fluid accumulator arrangement of claim 4, wherein the control module is configured to monitor the pressure of fuel in the first storage volume and the second storage volume when the volumes are isolated from one another, and is configured to link the first storage volume to the second storage volume for a predetermined time period in circumstances where the pressure in the first storage volume exceeds the pressure in the second storage volume.

6. A fluid accumulator arrangement suitable for use with a compression-ignition internal combustion engine, including a first storage volume, a second storage volume, a valve fluidly connecting the first storage volume and the second storage volume, and a control module arranged to receive a signal indicative of the stability of an engine operating condition after the engine has reached normal operation following an engine start and being operable to control the valve in response to the signal.

7. The fluid accumulator arrangement of claim 6, wherein in circumstances in which the signal indicates a relatively stable engine operating condition the control module operates the valve such that the first storage volume communicates with the second storage volume.

8. The fluid accumulator arrangement of claim 6, wherein in circumstances in which the signal indicates a relatively unstable engine operating condition, the control module operates the valve such that the first storage volume is isolated from the second storage volume.

9. The fluid accumulator arrangement of claim 6, wherein the signal is a value indicating the demanded fuel pressure in the first storage volume.

10. The fluid accumulator arrangement of claim 6, wherein the control module is arranged to receive a signal indicative of an engine start event, in which circumstances the valve control module operates the valve such that the first storage volume is isolated from the second storage volume.

11. A fluid accumulator arrangement suitable for use with a compression ignition internal-combustion engine comprising a first storage volume and a second storage volume, and a valve fluidly connected between the first storage volume and the second storage volume, wherein the valve is a three-way control valve and wherein, in a first position, the first storage volume communicates with the second storage volume, in a second position the first storage volume is isolated from the second storage and, in a third position, one of the first or second storage volumes communicates with a low pressure drain.

12. The fluid accumulator arrangement of claim 11, further comprising a further one or more storage volumes each provided with a respective two-way valve or three-way valve to connect said further one or more storage volumes to the first storage volume.

13. The fluid accumulator arrangement of claim 11, wherein the first storage volume communicates with one or more fuel injectors.

14. The fluid accumulator arrangement of claim 11, wherein the first storage volume includes a fluid pressure sensor.

15. The fluid accumulator arrangement of claim 11, wherein the first storage volume includes a connection for a high pressure fluid pump.

* * * * *